US012692207B1

(12) United States Patent
Bird et al.

(10) Patent No.: US 12,692,207 B1
(45) Date of Patent: Jul. 28, 2026

(54) ENCAPSULATED ENERGETIC MATERIALS AND METHODS OF MAKING ENCAPSULATED ENERGETIC MATERIALS

(71) Applicant: U.S. Government as Represented by the Secretary of the Army, Picatinny Arsenal, NJ (US)

(72) Inventors: David Bird, Newton, NJ (US); Elbert Caravaca, Budd Lake, NJ (US); Nathan Peabody, Weehawken, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 364 days.

(21) Appl. No.: 18/213,322

(22) Filed: Jun. 23, 2023

Related U.S. Application Data

(60) Provisional application No. 63/366,881, filed on Jun. 23, 2022.

(51) Int. Cl.
*C06B 45/24* (2006.01)
*C06B 21/00* (2006.01)

(52) U.S. Cl.
CPC ..... *C06B 45/24* (2013.01); *C06B 21/0025* (2013.01); *C06B 21/0083* (2013.01)

(58) Field of Classification Search
None
See application file for complete search history.

(56) References Cited

U.S. PATENT DOCUMENTS 3,977,922 A 8/1976 Inoue et al.
5,417,895 A * 5/1995 Oberth ..... C06B 45/10 149/19.92
5,468,313 A * 11/1995 Wallace ..... C06B 45/105 149/93
2013/0048163 A1* 2/2013 Hafner ..... C06B 45/30 149/6
2014/0227548 A1* 8/2014 Myrick ..... C10L 1/28 203/40

OTHER PUBLICATIONS

Bird et. al.; A Review: Advances and Modernization in U.S. Army Gun Propellants; The Minerals, Metals & Materials Society, 2021.
Manning et. al.; Enhanced propellant performance via environmentally friendly curable surface coating; Defence Technology 3; 2017; 131-142.
Wu et. al.; Properties and Application of a Novel Type of Glycidyl Azide Polymer (GAP)-Modified Nitrocellulose Powders; Propellants Explos. Pyrotech., 2015, 40, 67-73.

* cited by examiner

*Primary Examiner* — Aileen B Felton
(74) *Attorney, Agent, or Firm* — Smit Kapadia

(57) ABSTRACT

Embodiments of the current disclosure include energetic microcapsules, comprising: a core comprising a first energetic material; and a shell comprising a second energetic material encapsulating the core, wherein the first energetic material is different from the second energetic material, and wherein the core is 15% to 70% by weight of the energetic microcapsule and the shell is 30% to 85% by weight of the energetic microcapsule. Embodiments of the current disclosure further include methods of forming an energetic microcapsule, comprising: mixing an organic phase monomer and an aqueous phase monomer to form an emulsion; curing the emulsion at a predetermined temperature to form the energetic microcapsule; and coating the energetic microcapsule with a thermoplastic coating.

8 Claims, 10 Drawing Sheets

ENCAPSULATED ENERGETIC MATERIALS AND METHODS OF MAKING ENCAPSULATED ENERGETIC MATERIALS

CROSS-REFERENCE TO RELATED APPLICATIONS

This application claims priority to U.S. Provisional Application No. 63/366,881, filed Jun. 23, 2022, the entire disclosure of which is hereby incorporated by reference herein.

STATEMENT OF GOVERNMENT INTEREST

The inventions described herein may be manufactured, used and licensed by or for the United States Government.

FIELD OF THE INVENTION

Embodiments of the present disclosure generally relate to energetic materials and in particular to encapsulated energetic materials.

BACKGROUND OF THE INVENTION

Spherical energetics primarily made from nitrocellulose are common geometries for small and medium caliber gun propellants. Spherical geometries significantly reduce manufacturing time when compared to extruded propellants, and the loadability, packing density and safety are significantly improved due to the majority of the manufacturing process occurring in water. The rate of burning is controlled by deterrent coatings eliminating expensive precision manufacturing and cutting machines utilized in extrusion propellants.

Alternative energetics, such as liquid nitrate esters, are difficult to handle due to volatility and mobility, in addition to having high sensitivity to impact and friction. A need exists for a processing technique to improve the handleability of liquid nitrate esters.

Accordingly, improved encapsulated energetic materials and methods of forming encapsulated energetic materials are provided herein.

SUMMARY OF INVENTION

A first embodiment of the present disclosure includes an energetic microcapsule comprising: a core comprising a first energetic material; and a shell comprising a second energetic material encapsulating the core, wherein the first energetic material is different from the second energetic material, and wherein the core is 15% to 70% by weight of the energetic microcapsule and the shell is 30% to 85% by weight of the energetic microcapsule.

A second embodiment of the present disclosure may include the first embodiment, wherein the first energetic material is a nitrate ester.

A third embodiment of the present disclosure may include the first to second embodiments, wherein the second energetic material is a thermosetting polymer.

A fourth embodiment of the present disclosure may include the first to third embodiments, wherein the second energetic material is polyurea.

A fifth embodiment of the present disclosure may include the first to third embodiments, wherein the second energetic material is polyurethane.

A sixth embodiment of the present disclosure may include the first to third embodiments, wherein the second energetic material is glycidyl azide polymer.

A seventh embodiment of the present disclosure may include the first to sixth embodiments, wherein the shell comprises a coating.

An eighth embodiment of the present disclosure may include the seventh embodiment, wherein the coating is a polymer having a melting temperature greater than 65 degrees Celsius and an exotherm peak that is 50 degrees C. or more below the decomposition temperature of the energetic material.

A ninth embodiment of the present disclosure may include the seventh embodiment, wherein the coating is a thermoplastic coating.

A tenth embodiment of the present disclosure may include the seventh embodiment, wherein the coating is polyvinylpyrrilidone.

An eleventh embodiment of the present disclosure includes a method of forming an energetic microcapsule, comprising: mixing an organic phase monomer and an aqueous phase monomer to form an emulsion; curing the emulsion at a predetermined temperature to form the energetic microcapsule; and coating the energetic microcapsule with a thermoplastic coating.

A twelfth embodiment of the present disclosure may include the eleventh embodiment, wherein the organic phase monomer is one of methylene diphenyl diisocyanate (MDI), polyol modified MDI, or toluene diisocyanate.

A thirteenth embodiment of the present disclosure may include the eleventh to twelfth embodiments, wherein the aqueous phase monomer is one of hexamethylene diamine, methyl methacrylate, or N-isopropylacrylamide.

A fourteenth embodiment of the present disclosure may include the eleventh to thirteenth embodiments, wherein the coating is a polymer having a melting temperature greater than 65 degrees Celsius and an exotherm peak that is 50 degrees Celsius or more below the decomposition temperature of the energetic material.

A fifteenth embodiment of the present disclosure may include the eleventh to fourteenth embodiments, wherein the coating is polyvinylpyrrilidone.

A sixteenth embodiment of the present disclosure may include the eleventh to fifteenth embodiments, wherein the energetic microcapsule comprises: a core comprising a first energetic material; and a shell comprising a second energetic material encapsulating the core, wherein the first energetic material is different from the second energetic material, and wherein the core is 15% to 70% by weight of the energetic microcapsule and the shell is 30% to 85% by weight of the energetic microcapsule.

A seventeenth embodiment of the present disclosure may include the sixteenth embodiment, wherein the first energetic material is a nitrate ester.

An eighteenth embodiment of the present disclosure may include the sixteenth embodiment, wherein the second energetic material is a glycidyl azide polymer.

Other and further embodiments of the present disclosure are described below.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. However, the appended drawings illustrate only typical embodiments of the disclosure and are therefore not to be considered limiting of scope, for the disclosure may admit to other equally effective embodiments.

Figure 1:
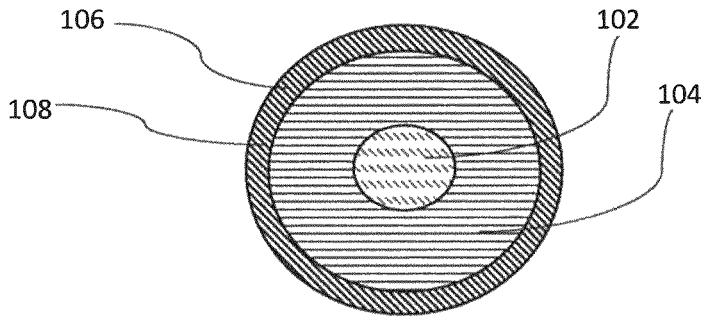
FIG. 1 depicts an energetic microcapsule in accordance with some embodiments of the present disclosure.

To facilitate understanding, identical reference numerals have been used, where possible, to designate identical elements that are common to the figures. The figures are not drawn to scale and may be simplified for clarity. Elements and features of one embodiment may be beneficially incorporated in other embodiments without further recitation.

DETAILED DESCRIPTION

FIG. 1 depicts an energetic microcapsule in accordance with some embodiments of the present disclosure. The energetic microcapsule 100 comprises a core 102 and a shell 104 encapsulating the core. As used herein, "encapsulate" or "encapsulating" refers to creating a barrier to separate a material, from an environment adjacent to the material. As used herein, the term "energetic material" means a material that is at least one of detonatable, explodable, implodable, ignitable, and combustible. In embodiments, the energetic microcapsule is spherical. In embodiments, the energetic microcapsule has a diameter of 1 micron to 1000 microns. In embodiments, the energetic microcapsule has a diameter of 50 microns to 1000 microns. In embodiments, the energetic microcapsule has a diameter of 100 microns to 1000 microns. In embodiments, the energetic microcapsule has a diameter of 300 microns to 1000 microns. In embodiments, the energetic microcapsule has a diameter of 500 microns to 1000 microns. In embodiments, the energetic microcapsule has a diameter of 700 microns to 1000 microns. In embodiments, the energetic microcapsule has a diameter of 900 microns to 1000 microns.

The core 102 comprises a first energetic material. In embodiments, the core is a solid phase material. In embodiments, the core is a liquid phase material. In embodiments, the first energetic material is a nitrate ester. As used herein, the term "nitrate ester" means and includes an ester having one or more nitrato ($NO_3$ or $ONO_2$) functional groups. For example, nitrate esters include nitroglycerin (NG), 1,2,4-butanetriol trinitrate (BTTN), pentaerythritol tetranitrate (PETN), ethylene glycol dinitrate (EGDN or nitroglycol), diethylene glycol dinitrate (DEGDN), diglycerol tetranitrate (DGTN), 1,2-propanediol dinitrate (PDDN), trimethylolethane trinitrate (TMETN), butyl-nitratoethylnitramine (butyl NENA), nitrocellulose (NC), triethyleneglycol dinitrate (TEGDN), poly(glycidyl nitrate) (PGN). The low water solubility and physical properties of nitrate esters lends them as suitable candidates for emulsion chemistry and encapsulation due to their more volatile nature and tendency to migrate within nitrocellulose polymer.

The shell 104 comprises a second energetic material. In embodiments, the shell 104 is a solid phase material. In embodiments, the second energetic material is different from the first energetic material. In embodiments, the second energetic material is a thermosetting polymer. As used herein, a "thermosetting polymer" is a prepolymer in a soft solid or viscous state that changes irreversibly into an infusible, insoluble polymer network by curing (e.g. via heat or through a chemical reaction (two-part epoxy, for example), or irradiation such as electron beam processing).

In embodiments, the second energetic material is one of polyurea or polyurethane. In embodiments, the second energetic material is a glycidyl azide polymer (GAP).

In embodiments, the core is 15% to 70% by weight of the energetic microcapsule and the shell is 30% to 85% by weight of the energetic microcapsule. In embodiments, the core is 25% to 70% by weight of the energetic microcapsule and the shell is 30% to 75% by weight of the energetic microcapsule. In embodiments, the core is 35% to 70% by weight of the energetic microcapsule and the shell is 30% to 65% by weight of the energetic microcapsule. In embodiments, the core is 45% to 70% by weight of the energetic microcapsule and the shell is 30% to 55% by weight of the energetic microcapsule. In embodiments, the core is 55% to 70% by weight of the energetic microcapsule and the shell is 30% to 45% by weight of the energetic microcapsule. In embodiments, the core is 65% to 70% by weight of the energetic microcapsule and the shell is 30% to 35% by weight of the energetic microcapsule. As used herein, "% by weight" is used to express the ratio of the mass of one component of a composition compared to the mass of the entire composition. For example, when the amount of a particular ingredient represents 1%, by weight of a concentrate, the mass of that ingredient is 1% of the mass of the entire concentrate. Similarly, when the amount of an ingredient is 50% by weight of the concentrate, the mass of that ingredient is 50% of the entire mass of the concentrate. Similarly, when a composition and/or a compound contains 10%, by weight of an ingredient, the mass of the ingredient is 10% of the total mass of the composition or compound. When only a concentration, amount, or percentage (without units) is listed, it is to be understood that the concentration or percentage is a concentration or percentage, by weight.

In embodiments, the energetic microcapsule 100 comprises a coating 106 around an outer surface 108 of the shell 104. In embodiments, the coating 106 is a water-soluble thermoplastic dispersant which aids in the spheroidal formation of the encapsulated propellant. In embodiments, the coating is polyvinylpyrrilidone (e.g., PVP K-30). PVP also lends itself as a good adhesive making the coated energetic microcapsule described herein a good candidate as an energetic feedstock for selective layer sintering (SLS) within the powder bed fusion family of additive manufacturing techniques. SLS materials are thermoplastic polymers that come in granular or spherical form. The thermoplastic PVP coating on the encapsulated propellant can be sintered together by a laser, thus fusing the encapsulated spheres together and allowing a three-dimensional (3D) part to be built, layer by layer in a 3D printer.

The thermoplastic coating is not limited to PVP. Those skilled in the art will recognize that many thermoplastics may be employed. Non-limiting examples of suitable thermoplastics include polyvinyl alcohol, polyethylene glycol, polyacrylamides, polyacrylic acid copolymer. The encapsulated propellants and related techniques of manufacture are particularly suited to water and non-water-soluble polymers with a melting and/or softening temperature greater than 65° C., and an exotherm peak and/or onset temperature 50° C. or more below the decomposition temperature of the energetic as measured by differential scanning calorimetry (DSC) in accordance with STANAG 4147. STANAG is the NATO abbreviation for Standardization Agreement, which sets up processes, procedures, terms and conditions for common military or technical procedures and equipment between the member countries of the alliance. STANAG 4147 deals with the chemical compatibility of ammunition components with explosives. As used herein, the decomposition temperature can be defined as a temperature at which chemical bonds are broken or violent oxidation occurs whereupon a material catches fire. In embodiments, the melting temperature of the polymer coating is less than the decomposition temperature of any energetic material used in the energetic microcapsule. For example, the melting temperature of the polymer coating is at least 50° C. less than the decomposition temperature of any energetic material used in the energetic microcapsule.

Spherical encapsulated propellants consisting of nitrate esters surrounded by a polymer wall are advantageously greater in impetus than ball propellant with reduced sensitivity and vapor pressure of the nitrate ester; thus, translating to easier handling. In addition, incorporating encapsulated propellants with legacy propellants has the capability to provide next generation, state of the art propellants setting a new standard with improved muzzle velocities and extended distancing with improved/tailored burn rates also mitigating known vapor pressure and migration issues associated with small molecule liquid nitrate esters.

Figure 2:
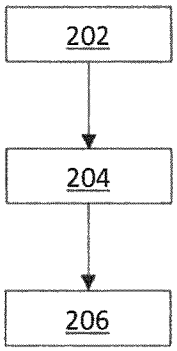
FIG. 2 depicts a method of forming energetic microcapsules 100, in accordance with some embodiments of the present disclosure.

FIG. 2 depicts a method of forming the energetic microcapsules 100 depicted in FIG. 1, in accordance with embodiments of the present disclosure. The method 200 generally begins at 202 by mixing an organic phase monomer and an aqueous phase monomer to form an emulsion. In some embodiments, exemplary aqueous phase monomers include hexamethylene diamine, methyl methacrylate, and N-isopropylacrylamide. In some embodiments, exemplary organic phase monomers include methylene diphenyl diisocyanate (MDI), polyol modified MDI, and toluene diisocyanate. The monomers will react accordingly, based on their functional groups and precipitate on the core particles under the action of mixing, heat and/or catalysts. Emulsion formation was carried out utilizing a resonant acoustic mixing (RAM) process. RAM systems seek to operate at the "resonant condition" of the mechanical system and generates a high level of energy, driving intense ingredient interaction at an ideal frequency. In an acoustic mixing process, acoustic energy is delivered to the materials to be mixed. An oscillating mechanical driver creates motion in a mechanical system. This energy is then acoustically transferred to the material to be mixed. The underlying technology principle is that the system operates at resonance resulting in a nearly complete exchange of energy between the mass elements and the elements in the mechanical system. Resonant acoustic mixing provides a highly efficient way of transferring mechanical energy directly into the mixing materials. Next at 204, the emulsion is cured at a predetermined temperature to form the energetic microcapsules. The cure temperature may vary and is dependent on the materials in forming the emulsion. Optionally, at 206, the energetic microcapsules are coating with a thermoplastic coating, for example, PVP.

Preparation of Energetic Microcapsules:

Example 1-Polyurea Encapsulated Trimethylolethane Trinitrate (TMETN)

3.265 g deionized (DI) water, 0.0078 g Antifoam emulsion AFE-1520 (Dow, Xiameter), and 0.0078 g sodium dodecyl sulfate (SDS) was added into a 20 mL mixing vessel equipped with a rotor-stator homogenizer. With the homogenizer in operation at 1,000 RPM, a pre-blended solution of 0.249 g polymeric diphenylmethane diisocyanate (PAPI 27, Polymeric MDI) and 2.496 g TMETN was fed by gravity into the aqueous solution during a 5 to 10 second period. The mixture was homogenized for one minute at 10,000 RPM. Upon completion of the homogenization, the mixture was placed in a jacketed reactor with the jacket pre-heated to 50°

Figure 3A:
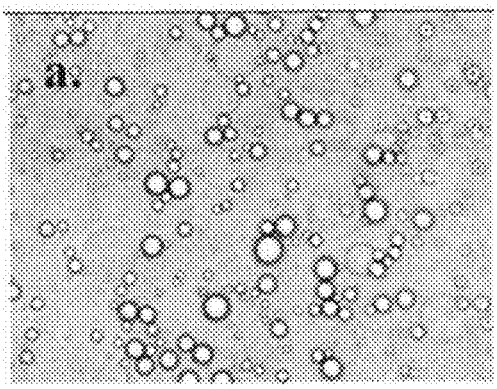
FIG. 3*a* is a microscopy image of an emulsion formed with trimethylolethane trinitrate (TMETN) stabilized by sodium dodecyl sulfate, in accordance with some embodiments of the present disclosure.
Figure 3B:
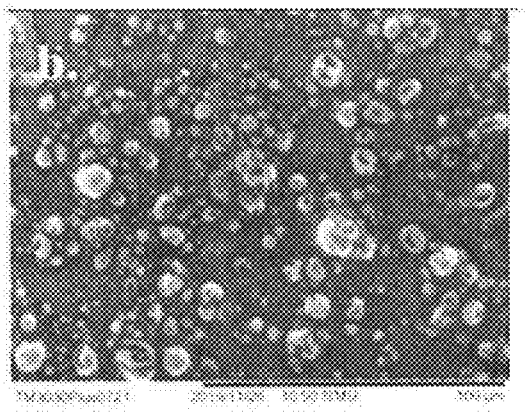
FIG. 3*b* is a microscopy image of polyurea microencapsulated TMETN after cure, in accordance with some embodiments of the present disclosure.
Figure 3C:
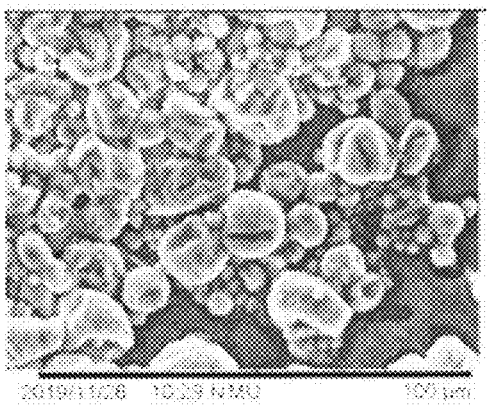
FIG. 3*c* is a microscopy image of polyurea microencapsulated TMETN after cure, in accordance with some embodiments of the present disclosure.
Figure 4A:
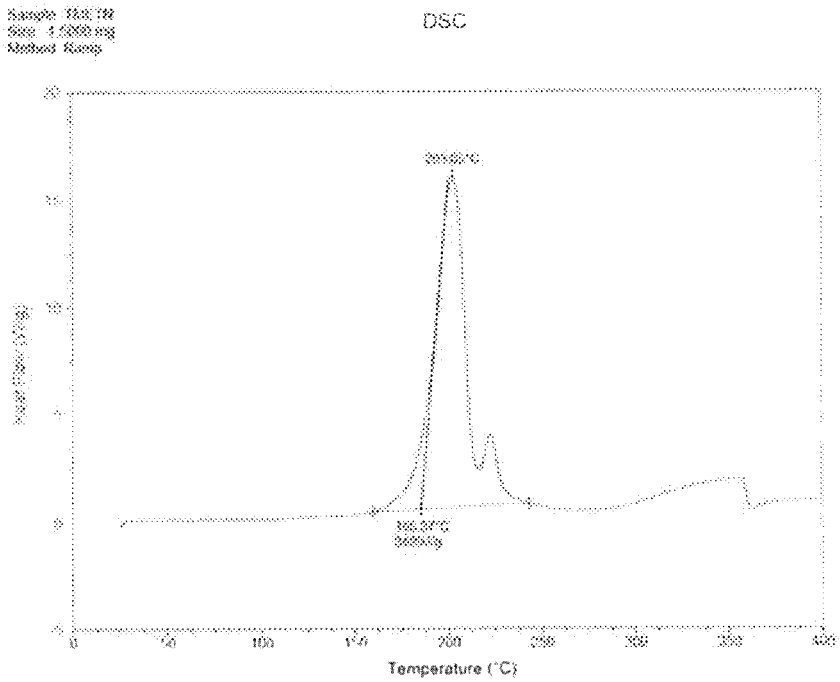
FIG. 4*a* is a plot showing differential scanning calorimetry (DSC) compatibility for neat TMETN, in accordance with some embodiments of the present disclosure.
Figure 4B:
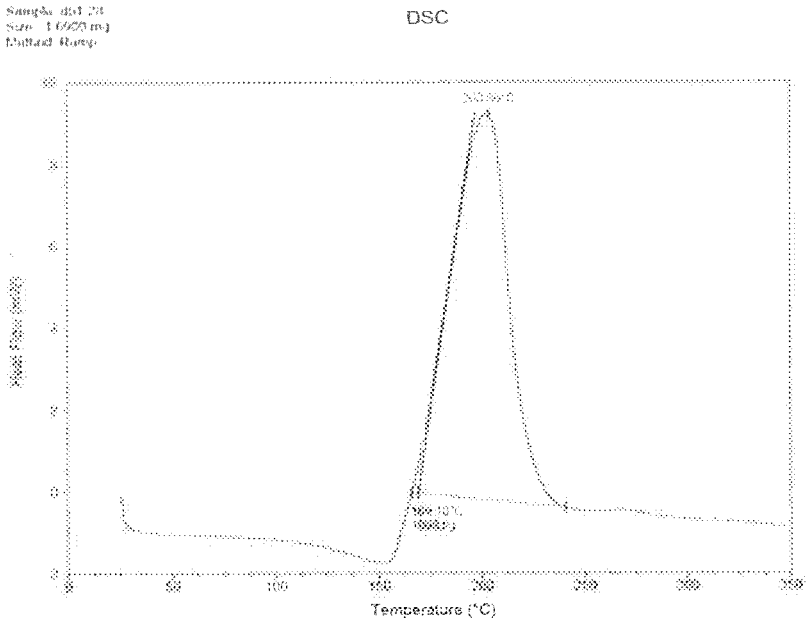
FIG. 4*b* is a plot showing DSC compatibility for polyurea encapsulated TMETN, according to an illustrative embodiment.

C. To the jacketed reactor, an amine solution of 0.107 grams 1,6 hexamethylene diamine (HMDA) and 0.142 g deionized water was added. After the amine solution addition, the mixture was allowed to cure with agitation at 50° C. for eight hours. The formulation was kept in water for desensitized storage, with some fractions divided up for microscopy, DSC and thermogravimetric analysis (TGA). FIG. 3*a* shows the emulsion formed with TMETN, stabilized by sodium dodecyl sulfate (SDS). FIG. 3*b* and FIG. 3*c* show Scanning Electron Microscopy (SEM) images of the resulting polyurea microencapsulated TMETN after cure. DSC data shows little change in the decomposition peak temperature for neat TMETN (FIG. 4*a*) compared to polyurea encapsulated TMETN (FIG. 4*b*), indicating compatibility between the polymer and TMETN.

Example 2-Sol-Gel Encapsulated TMETN

Into a 20 mL reactor vessel equipped with a rotor-stator homogenizer was added 5.49 g deionized (DI) water and 0.1 g cetyl ammonium chloride. With the homogenizer in operation at 1,000 RPM, a pre-blended solution of 0.7 g tetraethyl orthosilicate (TEOS) and 2.87 g trimethylolethane trinitrate (TMETN) was fed by gravity into the aqueous solution during a 5 to 10 second period. The mixture was homogenized for one minute at 10,000 RPM. Upon completion of the homogenization, the mixture was placed in a jacketed reactor with the jacket pre-heated to 50° C. The mixture was allowed to cure with agitation at 50° C. for eight hours and agitated at 21° C. for a further 8 hours. The formulation was kept in water for desensitized storage, with some fractions divided up for microscopy, DSC and TGA analysis.

Example 3-Polyurethane Encapsulated Nitroglycerin (NG)

Into a one-liter reactor vessel equipped with a rotor-stator homogenizer was added 411.6 g DI water. With the homogenizer in operation at 1,000 RPM, a pre-blended solution of 24.7 g GAP 5527 polyol (35 w/w % glycidyl azide polymer, 65 w/w % ethyl acetate), 1.95 g polymeric hexamethylene diisocyanate, and 41.15 g nitroglycerin solution (60 w/w % NG, 40 w/w % acetone) was fed by gravity into the aqueous solution during a 5 to 10 second period. The mixture was homogenized for one minute at 10,000 RPM. Upon completion of the homogenization, the mixture was placed in a jacketed reactor with the jacket pre-heated at 21° C. After the addition, 20.6 g of an aqueous 10 w/w % PVP K30 solution was added to the jacketed reactor and allowed to cure for 8 hours, allowing all desensitizing solvents to evaporate off. The resulting spheres are decanted from water and mixed with graphite at 1 wt. % of the collected solid spheres. The graphite coated spheres are placed in a dry house at 120° F. for 48 hours.

Figure 5A:
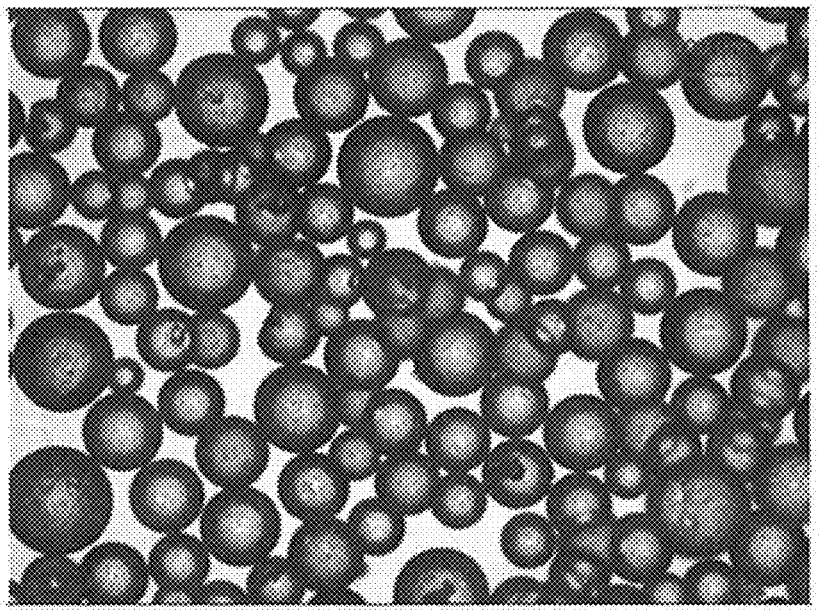
FIG. 5*a* is a microscopy images of glycidyl azide polymer (GAP) polyurethane nitroglycerin (NG) microcapsules at 100× magnification, in accordance with some embodiments of the present disclosure.
Figure 5B:
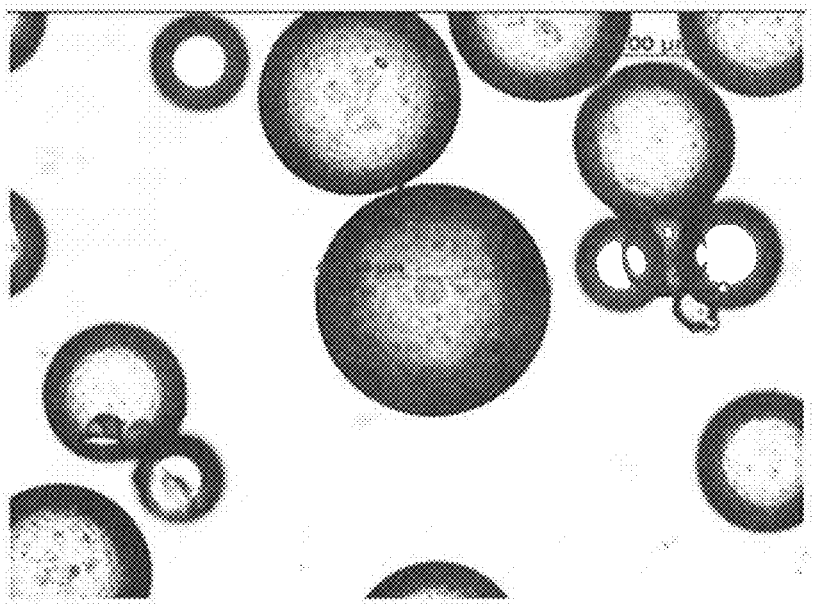
FIG. 5*b* is a microscopy images of GAP polyurethane NG microcapsules at 200× magnification, in accordance with some embodiments of the present disclosure.
Figure 5C:
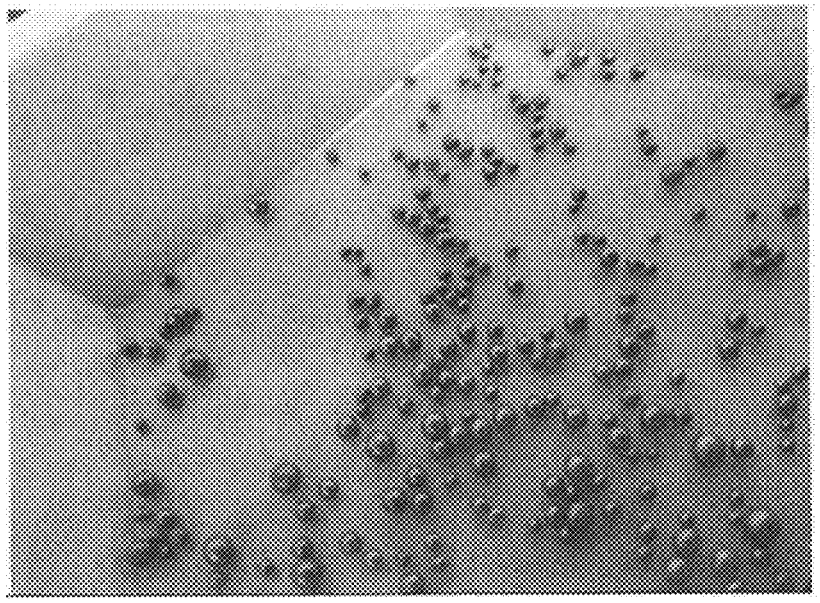
FIG. 5*c* is an image of spherical and polydisperse microencapsulated NG with a GAP polyurethane capsule, in accordance with some embodiments of the present disclosure.
Figure 5D:
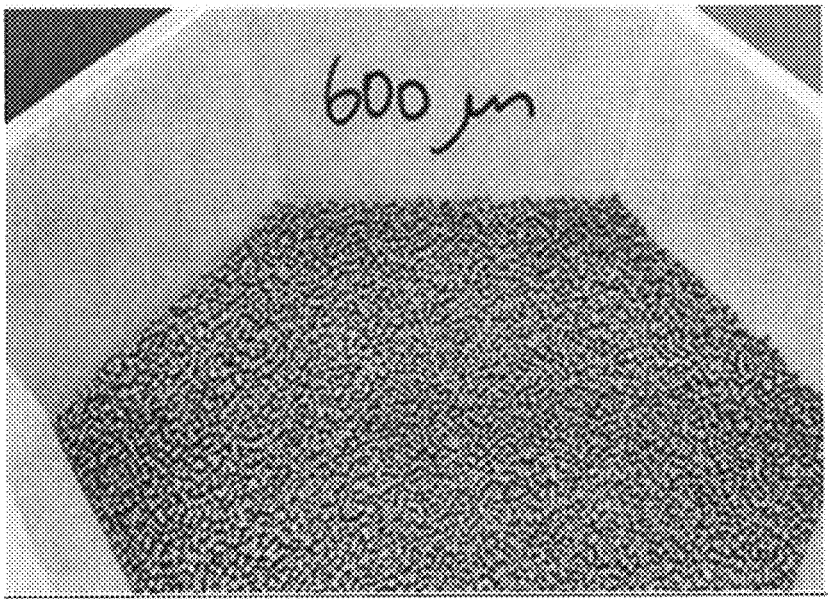
FIG. 5*d* is an image of sieved microencapsulated NG with a GAP polyurethane capsule, in accordance with some embodiments of the present disclosure.

FIGS. 5*a*-5*d* show images of microencapsulated NG with a GAP polyurethane capsule, designated as PAP-00506. FIG. 5*a* and FIG. 5*b* depicts microencapsulated NG with a GAP polyurethane capsule at 100× magnification and 200× magnification, respectively. The resulting spheres are spherical and polydisperse as seen in FIG. 5*c*. Therefore, the resulting spheres were sieved to create a narrower particle size distribution (PSD) as seen in FIG. 5*d*. Narrower particle size distribution is desirable for spherical gun propellant to ensure that uniform deflagration of the spheres occurs.

In some embodiments, preparation of GAP polyurethane encapsulated nitroglycerin utilizes RAM for emulsion preparation to improve safety and reduce cleaning requirements due to the bladeless operation of RAM mixing. Embodiments utilizing RAM involves adding the GAP, NG and isocyanate solution directly to the RAM mixing cup already with the loaded aqueous solution. The RAM is then operated at an acceleration of 50 G for one minute, and the mixture is then charged into a one-liter reaction vessel equipped with mechanical stirrer and internal thermometer and allowed to cure for 8 hours, allowing all desensitizing solvents to evaporate off. Further, RAM mixing is incorporated for graphite coating encapsulated propellant spheres.

Sensitivity of Microcapsules

The BAM Friction test is the NATO standard friction test and is essential for characterization because the friction sensitivity between hard surfaces is one of the most frequent causes of accidental explosions. A test result is considered "positive" if the lowest friction load at which one "event" occurs in six trials is less than 80 N; thereby classifying the substance as too dangerous for transport in the form in which it was tested. Otherwise, the test result is considered "negative". The sensitivity range of 160-360 N is considered "low" (i.e., considered to be insensitive or have low sensitivity to friction). The results of the sensitivity test of the GAP urethane encapsulated NG (Sample 1), prepared as described above in Example 3, compared to a 1% nitrodiphenylamine (NDPA) stabilized, 99% NG mix are shown below in Table 1. Neat NG with 1% stabilizer NDPA is not reported friction sensitive, and encapsulating NG does not significantly increase friction sensitivity.

TABLE 1

Friction Sensitivity Testing of NG compositions

| Formulation | Friction Sensitivity | Result |
|---|---|---|
| Mix 1, NG 99%, 1% NDPA | 1/10 @ 27 kg or >360 N | Low |
| Sample 1 | 0/6 @ 3.63 kg or 160 N | Low |

To evaluate the electrostatic discharge hazards (human ESD) associated with the handling of explosives, a static spark machine is used, such as Allegany Ballistics Laboratory's (ABL) Electrostatic Discharge (ESD) machine. The ABL ESD machine can be used to express electrostatic discharge sensitivity results in calibrated engineering units (Joules). The data can be then compared to the potential charge generation and discharge capability of known energetics and formulations. The machine consists of a grounded base plate, a metal sample holder that attaches to the base plate, a discharge needle above the sample, a high-voltage supply and a capacitor bank. The high-voltage supply charges a capacitor or series of capacitors after which the charged capacitor(s) are discharged to ground through the discharge needle and sample. The amount of electrostatic energy imparted to the sample is controlled by varying the voltage and capacitance in the capacitor bank. The results obtained are expressed as a zero in 10 or one-in-ten at a specific voltage and joules. One reaction in ten trials at ≤0.25 joules is considered spark sensitive. Primary explosives show reaction at 0.1 joule. As can be seen in Table 2, Sample 1 is not considered spark sensitive compared to other common energetic materials.

TABLE 2

Spark Sensitivity for common energetics compared with encapsulated NG (DB2-12).

| Mixtures and compositions | Spark Sensitivity |
|---|---|
| Mix 1, NG 99%, 1% NDPA* | 0/10 @ 1.0 Joule |
| PETN* | 0/10 @ 1.0 Joule |
| RDX* | 0/10 @ 1.0 joule |
| Sample 1** | 0/10 @ 0.25 Joule |

*Lawrence Livermore National Labs Spark Sensitivity test,
ABL Spark Sensitivity Test The sensitivity to impact stimuli is also one of the most important characteristics of energetic materials defining their safety in handling, processing or transportation. Its determination is a necessary part of characterization of new explosives, modified formulations or manufacturing conditions. It is also used for defining influences of impurities or ageing, in the quality control of manufactured explosives, in surveillance of in-service explosives and in transport/storage classification of explosive materials. The BAM Fall Hammer (also known as BAM Impact Tester or BAM Drop Hammer) is designed to determine the sensitivity of explosive materials to the impact stimuli by a falling drop weight in accordance with the BAM procedure. The results clearly show nitroglycerin is particularly sensitive and behaves as a sensitive material should; whereas Sample 1** is significantly less sensitive to impact, thus easier to handle.

TABLE 3

Impact Sensitivity of NG compositions

| Mixtures and compositions | Weight (kg) | Drop height (cm) | Number of Trials | Number of Initiations |
|---|---|---|---|---|
| Liquid NG (100%)* | 1.0 | 3.0 | 10 | 9 |
| Sample 1** | 5.0 | 20.0 | 6 | 0 |

*Olin Corp. Impact Sensitivity Test Apparatus,
**BAM Test method

Example 4-Triazoline Encapsulated NG 41.16 g DI water was added into a 250 mL reactor vessel equipped with a rotor-stator homogenizer. With the homogenizer in operation at 1,000 RPM, a pre-blended solution of 2.47 g GAP 5527 polyol (35 w/w % glycidyl azide polymer, 65 w/w % ethyl acetate), 0.195 g monomeric trimethylolpropyl triacrylate (TMPTA), and 4.115 g nitroglycerin solution (60 w/w % NG, 40 w/w % acetone) was fed by gravity into the aqueous solution during a 5 to 10 second period. The mixture was homogenized for one minute at 10,000 RPM. Upon completion of the homogenization, the mixture was placed in a jacketed reactor with the jacket pre-heated at 21° C. After the addition, 2.06 g of an aqueous 10 w/w % PVP K30 solution was added to the jacketed reactor and allowed to cure for 8 hours, allowing all desensitizing solvents to evaporate off. The resulting spheres are decanted from water and mixed with graphite at 1% weight of the collected solid spheres. The graphite coated spheres are placed in a dry house at 120° F. for 48 hours.

Closed Vessel Testing and Gun Firing of Encapsulated Propellant

Closed Vessel Testing of GAP Encapsulated NG as an Ignitor

Figure 6:
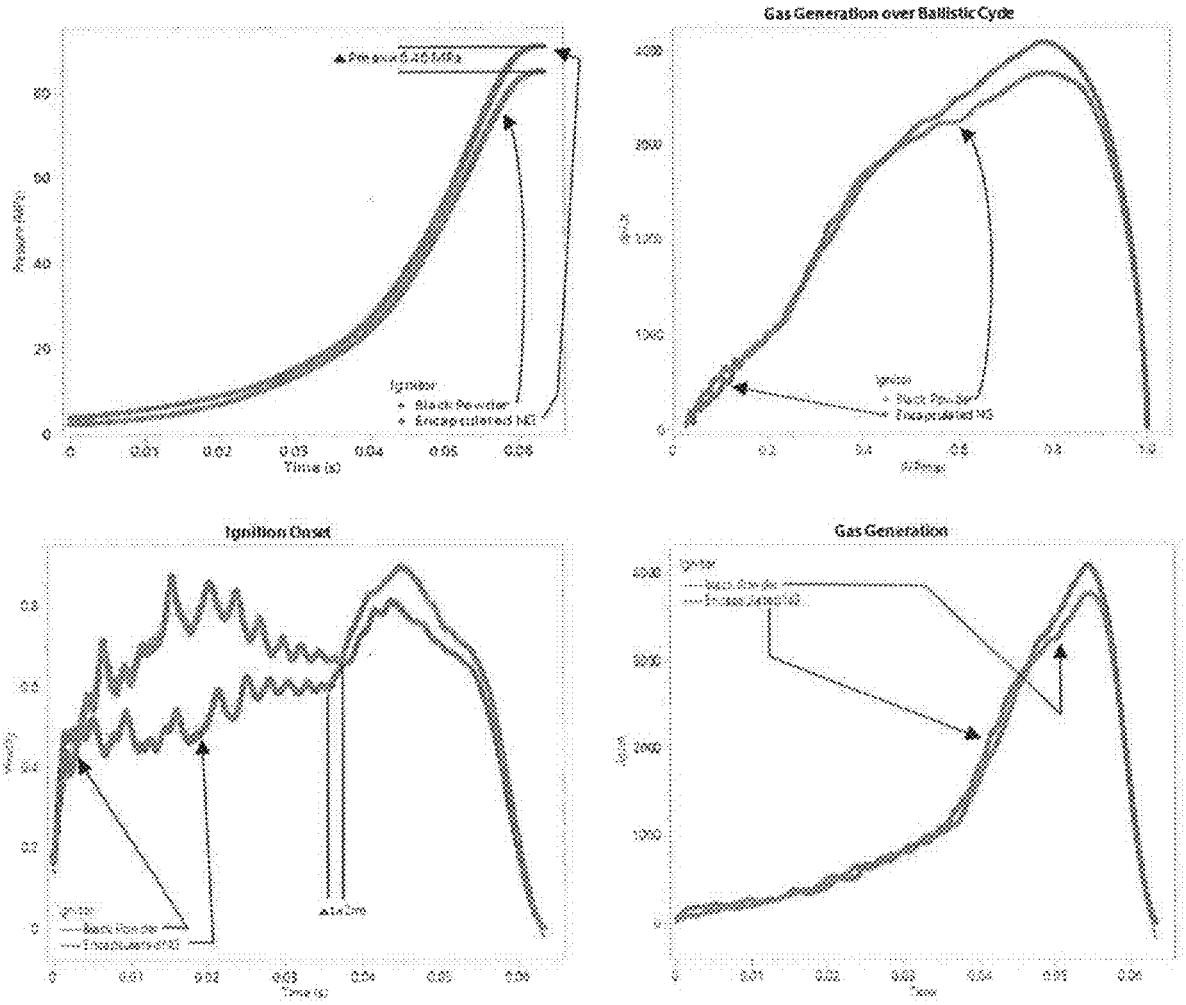
FIG. 6 depicts four plots comparing pressure curves, gas generation, gas generation over ballistic cycle, and ignition onset for microencapsulated NG and black powder during closed vessel ignitor tests, in accordance with some embodiments of the present disclosure.

To evaluate how GAP Encapsulated NG performs as an ignitor material, two identical 19.97 g samples of a pure single base gun propellant were fired in a 200cc closed bomb. The first sample used 0.5 g of 650 micron diameter GAP Encapsulated NG spheres as an ignition source, and the second used 0.5 g of Class 5 GOEX black powder. The results of this side-by-side comparison are shown in FIG. 6 and indicate that GAP Encapsulated NG performs comparably to traditional ignitors, with modest performance gains possible. GAP Encapsulated NG boosts the gas generation rate of the propellant during the crucial middle portion of the ballistic cycle, resulting in a 7.7% increase in peak pressure for the same amount of material. It also exhibits less ringing during the ignition phase, indicating a more uniform flame spread that affects a 2 ms reduction in ignition delay (an improvement of 5.4%). This test is representative of typical propellant evaluation methods and indicates that GAP Encapsulated NG is suitable as an alternative ignition method for gun propellants.

Closed Vessel Testing GAP Encapsulated NG as a Propellant

Burn rates were determined by closed bomb testing and analysis. Samples were weighted out, grain dimensioned, and density measured for closed bomb analysis at 21° C. The closed bomb test is designed to determine linear burning rates of energetic compositions at elevated pressures. The closed bomb was a 59-cc vessel filled to a 0.15 g/cc loading density with encapsulated propellant, PAP-00506 and 0.0030" flake propellant for comparison. The closed bomb test results are shown in FIG. 6. Propellant burn rates, pressure coefficients and pressure exponents are tabulated in Table 4. Formulations that have an (a)<1 are fairly irresponsive towards pressure changes and are desirable for deflagration performance. Ballistic modifiers can be added to formulations to tailor burn rates at low pressures.

Figure 7A:
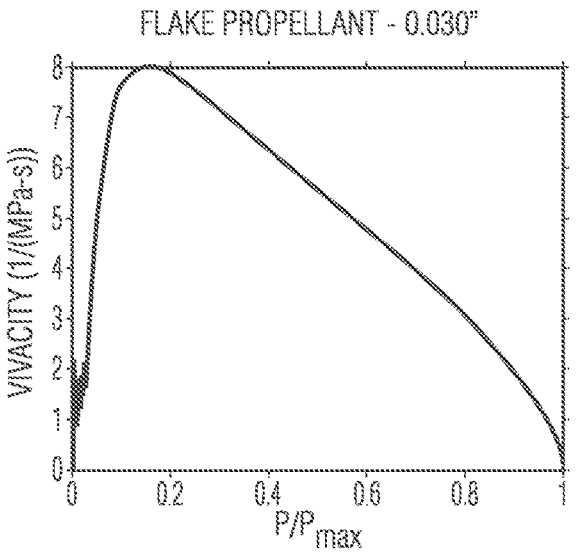
FIG. 7A is a plot showing the dynamic vivacity curve for conventional nitrocellulose-based flake propellant, in accordance with some embodiments of the present disclosure.
Figure 7B:
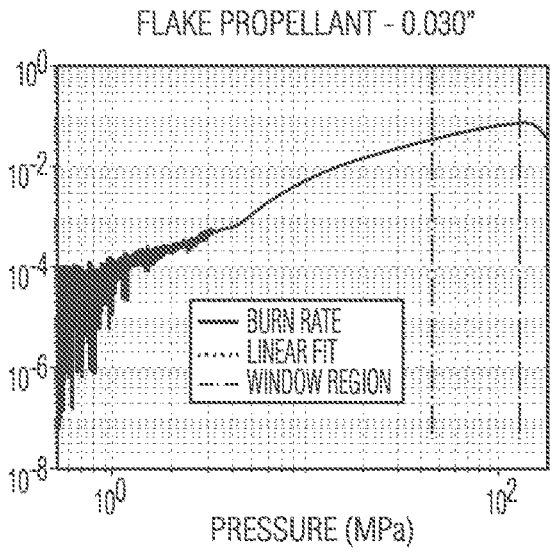
FIG. 7B is a plot showing the burn rate curve for conventional nitrocellulose-based flake propellant, in accordance with some embodiments of the present disclosure.
Figure 7C:
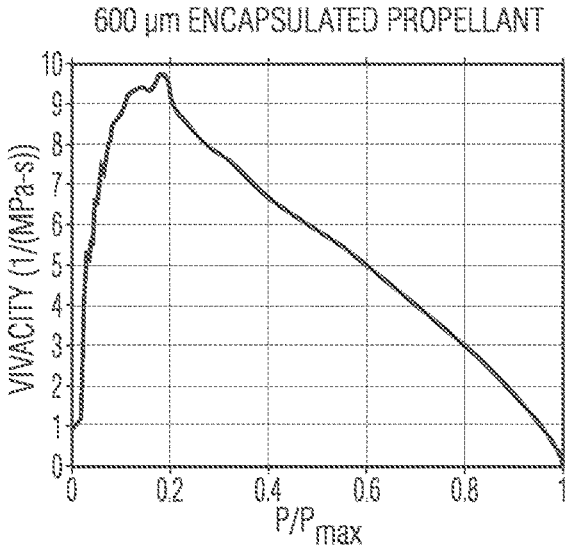
FIG. 7C is a plot showing the dynamic vivacity curve for sample designated PAP-00506, in accordance with some embodiments of the present disclosure.
Figure 7D:
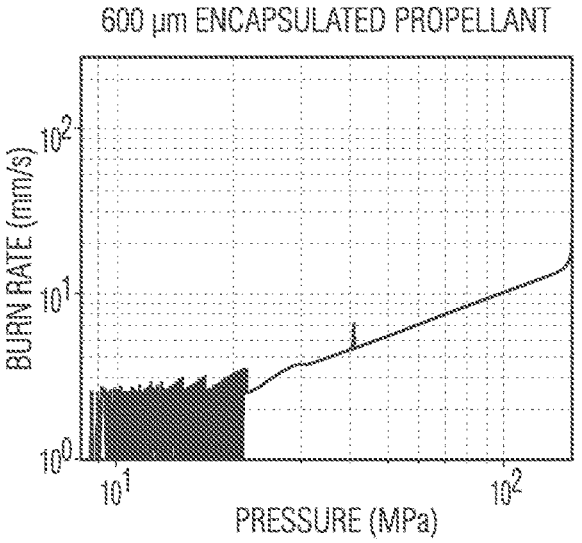
FIG. 7D is a plot showing the burn rate curve for sample designated PAP-00506, in accordance with some embodiments of the present disclosure.

To gauge relative performance of this encapsulated material as a propellant, dynamic vivacity is investigated to determine combustion behavior. FIG. 7A-D shows the comparison of dynamic vivacity curves between PAP-00506 and conventional NC based flake propellant. FIG. 7A and FIG. 7B depict, respectively, the dynamic vivacity curve and burn rate curve for conventional NC based flake propellant. FIG. 7C and FIG. 7D depict, respectively, the dynamic vivacity curve and burn rate curve for PAP-00506. Vivacity is an expression of the mass rate of combustion or the rate of gas generation. Under the assumption of spatially constant propellant composition, a change in vivacity indicates a change in available surface area. In these plots, the dynamic vivacity has been calculated and plotted against the normalized pressure in the closed bomb (P/Pmax). Higher vivacity values indicate higher gasification rates. Assuming the apparent burn rates are constant, the changes in the gasification are due to an increase in the burning surface area. PAP-00506 has a comparable vivacity and burn rate to flake propellant as shown in FIG. 7A-D.

TABLE 4

Burn rate pressure exponent and coefficient.

| Formulation | Pressure Coefficient - $\alpha$ | Pressure Exponent - $\beta$(mm/(s-MPa^$\alpha$)) |
|---|---|---|
| 600 μm Encapsulated propellant | 0.87 | 0.1856 |
| 0.030" Flake Propellant | 0.71 | 0.2343 |

From closed vessel tests, the burn rate can be predicted using the Vielle's burn rate law shown in equation (1) below, wherein P is the pressure in the chamber, a is the burn rate pressure exponent, and β is the burn rate pressure coefficient.

$$\text{Burn rate } (BR) = \beta P^{\alpha} \quad (1)$$

This burn rate was then used in the Interior Ballistic High Velocity Gun version 2 (IBHVG2) code to model ballistic performance. This code was utilized to determine the maximum pressures and muzzle velocities. For the ballistic performance test, AFP-001 propellant, an Air Force fielded propellant with known ballistic behavior in the 30 mm gun is used as a baseline. PAP-00506, AFP-001, and AFP-001 blended with PAP-00506 were used in the 30 mm×173 mm sub-scale ballistic performance tests. All ballistic testing was conducted at ambient temperatures.

Gun Firing

Figure 8A:
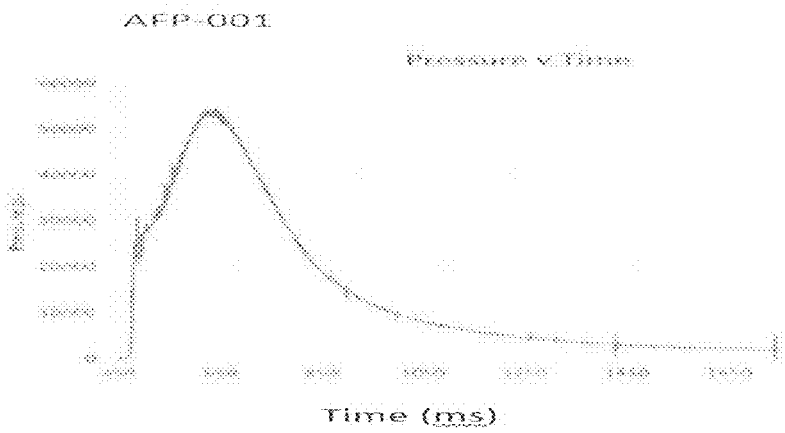
FIG. 8*a* is a plot showing a pressure curve for AFP-001, in accordance with some embodiments of the present disclosure.
Figure 8B:
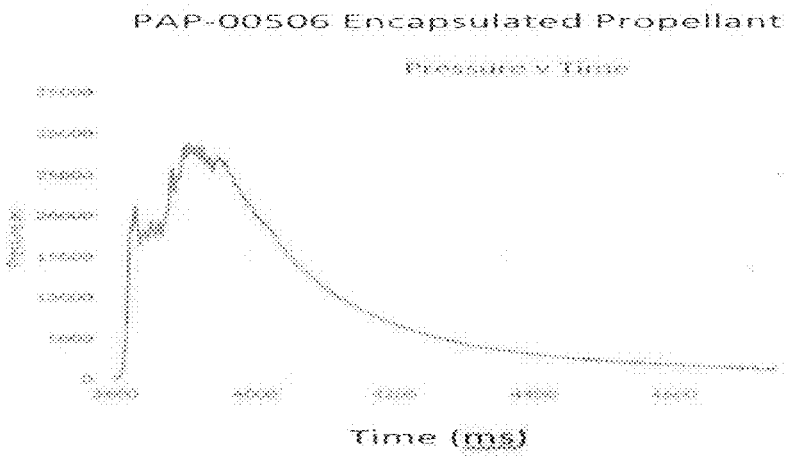
FIG. 8*b* is a plot showing a pressure curve for PAP-00506 encapsulated propellant, in accordance with some embodiments of the present disclosure.
Figure 8C:
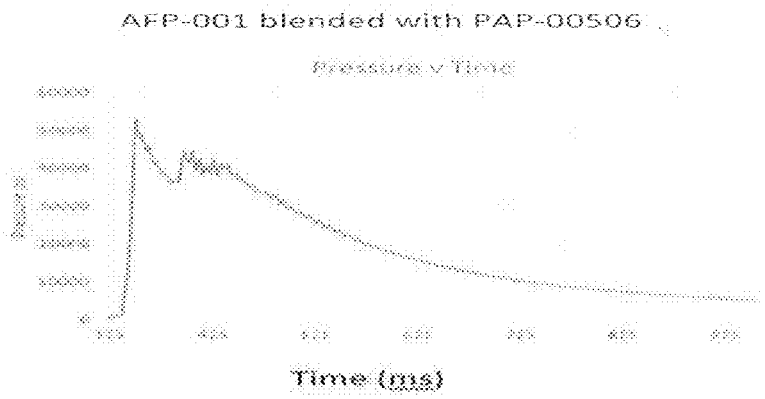
FIG. 8*c* is a plot showing a pressure curve for AFP-001 blended with PAP-00506 encapsulated propellant, in accordance with some embodiments of the present disclosure.

The results for the 30 mm sub-scale gun firing (30 mm×173 mm) can be seen in Table 5. Rounds 1-3 were conducted as warmer rounds with AFP-001. PAP-00506 blended with AFP-001 was selected for the initial proof of concept in Round 4, and Round 5 was PAP-00506 by itself. Round 5 used brown paper dunnage due to the ullage present from not having a full charge weight. Final ballistic results for all Rounds are shown in FIG. 8*a*-8*c*, with muzzle velocities and breech pressures tabulated for all formulations in Table 2. The muzzle velocity of encapsulated material PAP-00506 blended with AFP was slightly higher than AFP-001 alone. This increase in muzzle velocity is approximately 5 percent, but a heavier projectile weight was used with warmer Rounds 1-3 (projectile weight-378 g), compared to AFP-001 blended with PAP-00506 (projectile weight-230 g), so it is difficult to draw conclusions. The Breech Pressures for Encapsulated PAP-00506 blended with AFP-001 were slightly lower than the AFP-001 solo at ambient temperatures. Overall, muzzle velocities were less than the specification (AFP) but proved the viability of EP formulations for medium caliber ammunition; with 60.8 g of PAP-00506 giving a muzzle velocity of 792 m/s compared to a muzzle velocity of 1014 m/s with 152 g AFP, a scale factor of 2.5 times more propellant for the latter.

TABLE 5

30 × 173 mm Gun Firing

| Round # | AFP-001 (g) | Encapsulated PAP - 00506 (g) | Muzzle Velocity ($ms^{-1}$) | Peak Pressure (psi) | Projectile weight (g) |
|---|---|---|---|---|---|
| 1 | 152 | — | 1014 - | 55000 - | 378 |
| 2 | 152 | — | average 3 | average | 378 |
| 3 | 152 | — | shots | 3 shots | 378 |
| 4 | 126 | 11.4 | 1070 | 53,386 | 230 |
| 5 | 0 | 60.8 | 792 | 29,095 | 230 |

Encapsulated NG as a Burn Rate Modifier

Burn rate modifiers are used in conventional propellant formulations to control the ballistic performance of the propellant. The modifiers are effective because they change the combustion mechanism and affect the thermal conduction process which is one of the dominant processes influencing the burning characteristics of the propellant. The highly exothermic reaction and high combustion temperatures associated with burn rate modifiers assists in the rapid heating and ignition of neighboring particles, thus yielding conductive and convective heat transfer from the embedded burn rate modifier to the propellant in such a way that it improves ballistic performance (increases burn rate and/or decreases the pressure exponent of the burning rate).

Figure 9A:
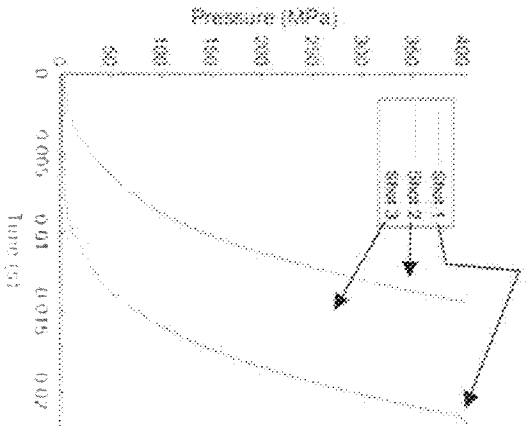
FIG. 9*a* is a plot showing a pressure curve for M5 propellant, in accordance with some embodiments of the present disclosure.
Figure 9B:
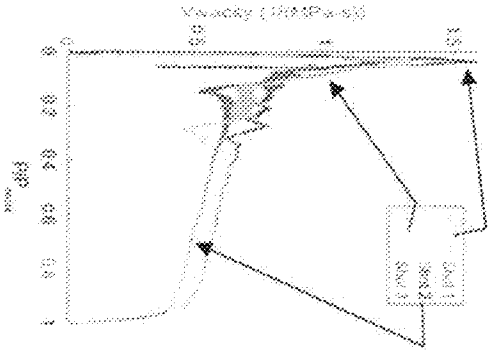
FIG. 9*b* is a plot showing dynamic vivacity curve for M5 propellant, in accordance with some embodiments of the present disclosure.
Figure 9C:
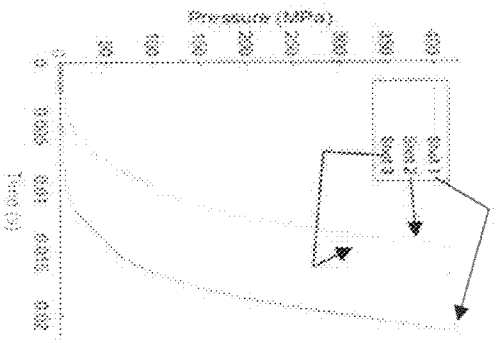
FIG. 9*c* is a plot showing a pressure curve for encapsulated NG spheres with M5 propellant, in accordance with some embodiments of the present disclosure.
Figure 9D:
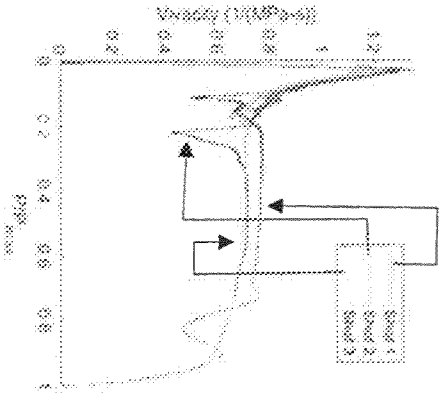
FIG. 9*d* is a plot showing a dynamic vivacity curve for encapsulated NG spheres with M5 propellant, in accordance with some embodiments of the present disclosure.

Encapsulated NG spheres were added to M5 propellant and processed under standard propellant extrusion conditions, then tested in a closed bomb to investigate ballistic performance. The addition of encapsulated NG to M5 propellant significantly increases the burn rate. FIG. 9*a* is a plot showing a pressure curve for M5 propellant. FIG. 9*b* is a plot showing dynamic vivacity curve for M5 propellant. FIG. 9*c* is a plot showing a pressure curve for encapsulated NG spheres with M5 propellant. FIG. 9*d* is a plot showing a dynamic vivacity curve for encapsulated NG spheres with M5 propellant.

Looking at FIGS. 9*a*-9*d*, the geometry of the two propellants was the same but from observation of the vivacity curves, the M5 propellant appears slightly regressive, as expected, whereas the M5 propellant with encapsulated NG appears neutral. The addition of the encapsulated NG is directly increasing the gas generation without negatively impacting surface area progression or shattering propellant. The NG spheres enable the propellant to burn truer to its form factor, not less. Therefore, as an additive, encapsulated NG directly enhances the burn rate of existing propellant formulations without negatively changing mechanical properties or compromising propellant function.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integer or step. When used herein the term "comprising" can be substituted with the term "containing" or "including" or sometimes when used herein with the term "having".

When used herein "consisting of" excludes any element, step, or ingredient not specified in the claim element. When used herein, "consisting essentially of" does not exclude materials or steps that do not materially affect the basic and novel characteristics of the claim.

In each instance herein any of the terms "comprising", "consisting essentially of" and "consisting of" may be replaced with either of the other two terms.

While the foregoing is directed to embodiments of the present disclosure, other and further embodiments of the disclosure may be devised without departing from the basic scope thereof.

What is claimed is:

1. A method of forming an energetic microcapsule, comprising:

mixing an organic phase monomer and an aqueous phase monomer to form an emulsion;

curing the emulsion at a predetermined temperature to form the energetic microcapsule; and coating the energetic microcapsule with a thermoplastic coating.

2. The method of claim 1, wherein the organic phase monomer is one of methylene diphenyl diisocyanate (MDI), polyol modified MDI, or toluene diisocyanate.

3. The method of claim 1, wherein the aqueous phase monomer is one of hexamethylene diamine, methyl methacrylate, or N-isopropylacrylamide.

4. The method of claim 1, wherein the coating is a polymer having a melting temperature greater than 65 degrees Celsius and an exotherm peak that is 50 degrees Celsius or more below the decomposition temperature of the energetic material.

5. The method of claim 1, wherein the coating is polyvinylpyrrilidone.

6. The method of claim 1, wherein the energetic microcapsule comprises: a core comprising a first energetic material; and a shell comprising a second energetic material encapsulating the core, wherein the first energetic material is different from the second energetic material, and wherein the core is 15% to 70% by weight of the energetic microcapsule and the shell is 30% to 85% by weight of the energetic microcapsule.

7. The method of claim 6, wherein the first energetic material is a nitrate ester.

8. The method of claim 6, wherein the second energetic material is a glycidyl azide polymer.

* * * * *